United States Patent [19]

Sharman

[11] 3,935,131

[45] Jan. 27, 1976

[54] HIGH SUDSING PHOSPHATE-FREE DETERGENT COMPOSITION

[75] Inventor: Samuel H. Sharman, Berkeley, Calif.

[73] Assignee: Chevron Research Company, San Francisco, Calif.

[22] Filed: July 2, 1973

[21] Appl. No.: 375,998

[52] U.S. Cl. ..... 252/555; 252/554; 252/557

[51] Int. Cl.[2].... C11D 1/29; C11D 1/28; C11D 3/20

[58] Field of Search ..... 252/554, 557, 89, 555

[56] References Cited

UNITED STATES PATENTS

| | | | |
|---|---|---|---|
| 2,956,026 | 10/1960 | Lew | 252/557 |
| 3,565,809 | 2/1971 | Sharman | 252/555 X |
| 3,704,228 | 11/1972 | Eckert et al. | 252/117 |
| 3,754,561 | 8/1973 | Sharman et al. | 252/555 X |
| 3,843,707 | 10/1974 | Danzik et al. | 252/551 X |

FOREIGN PATENTS OR APPLICATIONS

| | | | |
|---|---|---|---|
| 244,835 | 1/1963 | Australia | 252/559 |

OTHER PUBLICATIONS

G. D. Miles et al., "Film Drainage," *J. Am. Oil Chemists'Soc.*, 27, pp. 268–273, (1950).

*Primary Examiner*—Leland A. Sebastian
*Assistant Examiner*—E. A. Miller
*Attorney, Agent, or Firm*—G. F. Magdeburger; John Stoner, Jr.; J. T. Brooks

[57] ABSTRACT

High sudsing phosphate-free heavy duty detergent composition comprises a compound of the formula

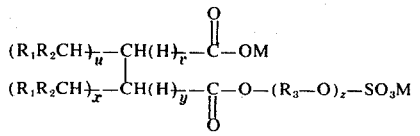

in which $R_1$ and $R_2$ are substantially linear saturated or unsaturated aliphatic groups of 3 to 19 carbon atoms, $R_3$ is alkylene of 2 to 4 carbon atoms, $u$, $v$, $x$ and $y$ are 0 or 1, $z$ is an integer 1 to 4, M is H or a water-soluble salt-forming cation, the sum of the carbon atoms in $R_1$ and $R_2$ is 13 to 21, the sum of the unsaturated sites in $R_1$ and $R_2$ is 0 to 1, the sum of $u$ and $v$ is 1, the sum of $x$ and $y$ is 1, and the sum of $u$ and $x$ is 1, and as a foam enhancing component, from 0.05 to 0.30 parts by weight of an essentially straight chain primary alcohol of 11 to 14 carbon atoms.

6 Claims, No Drawings

HIGH SUDSING PHOSPHATE-FREE DETERGENT COMPOSITION

FIELD OF THE INVENTION

This application is concerned with heavy duty phosphate free detergent compositions having enhanced foaming characteristics.

BACKGROUND OF THE INVENTION

U.S. patent application Ser. No. 259,924, filed June 5, 1972, now U.S. Pat. No. 7,843,707, discloses as detergent active materials certain sulfated glycol or polyglycol half esters of alkyl or alkenyl succinic acids wherein the alkyl or alkenyl group contains from about 14 to about 22 carbon atoms and the glycol moiety of the ester contains from 1 to 4 units of 2 to 4 carbon atoms and the sulfate group is terminally attached to the glycol or polyglycol chain.

These materials may be compounded into heavy duty detergent formulations which do not require the presence of a conventional sequestering type builder. The compositions have excellent detergency, are easily biodegradable and when certain of the half ester salts are employed have surprisingly low fish toxicity values. The heavy duty detergents compounded with these actives are low-foaming materials—that is, when employed in automatic clothes washing machines produce a very low volume of suds. While this characteristic is desirable for side-loading washers, it is often considered desirable for top loading washers that a substantial volume of foam be produced.

SUMMARY OF THE INVENTION

Surprisingly it has now been found that heavy duty detergent compositions having excellent foam producing properties comprise 1 part by weight of a detergent active and from 0.05 to 0.30 part by weight of a primary, essentially straight chain alcohol of 10 to 14, preferably 11 to 13 carbon atoms. The detergent active component is preferably a compound of the formula:

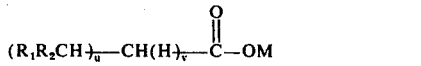

in which $R_1$ and $R_2$ are substantially linear saturated or unsaturated aliphatic groups of 2 to 19 carbon atoms, $R_3$ is alkylene of 2 to 4 carbon atoms, $u$, $v$, $x$ and $y$ are 0 or 1, $z$ is an integer 1 to 4, M is H or a water-soluble salt-forming cation, the sum of the carbon atoms in $R_1$ and $R_2$ is from about 13 to 21 carbon atoms, the sum of unsaturated sites in $R_1$ and $R_2$ is 0 to 1, the sum of $u$ and $v$ is 1, the sum of $x$ and $y$ is 1, and the sum of $u$ and $x$ is 1.

Thus the preferred compounds are preferably derived from hydrocarbyl succinic anhydrides wherein the attachment of the succinic moiety to the hydrocarbyl group is at carbon atoms other than the 1 and 2 carbon atoms of the hydrocarbyl chain. Such attachment as in this application is defined as "central attachment". Bonding at carbon atoms 1 and 2 of the hydrocarbyl group is defined as "end attachment".

In an additional preferred embodiment z is an integer of 1 to 3, preferably 1 to 2, most preferably 2, and $R_3$ is ethylene. It is further preferred that the sum of carbon atoms in $R_1$ and $R_2$ is from 15 to 17. Thus, the preferred materials are sulfate salts of half esters produced by reacting ethylene glycol or diethylene glycol with an alkyl or alkenyl succinic anhydride having 16 to 18 carbon atoms in the side chain. The diethylene glycol derivative is most preferred as is the alkyl derivative.

The hydrocarbyl radicals illustrated in the formula by $R_1R_2CH$— include such groups as tetradecyl, pentadecyl, hexadecyl, heneicosyl, docosyl, tetradecenyl, pentadecenyl, hexadecenyl, heneicosenyl and docosenyl.

Typical compounds illustrating $R_1$, $R_2$ and $R_3$ are listed as follows:

| $R_1$ | $R_2$ | $R_3$ | Z | M |
|---|---|---|---|---|
| ethyl | undecyl | ethylene | 1 | Na |
| propyl | undecenyl | 1,2-propylene | 2 | K |
| butenyl | tridecyl | 1,3-propylene | 1 | $NH_4$ |
| pentyl | dodecyl | 1,4-butylene | 1 | Na |
| hexenyl | tetradecyl | 1,2-propylene | 3 | Na |
| heptyl | heptyl | ethylene | 4 | K |
| decenyl | undecyl | ethylene | 1 | Na |
| propyl | heptadecyl | ethylene | 2 | Na |
| nonyl | octyl | ethylene | 2 | Na |
| octyl | otcyl | ethylene | 1 | Na |
| heptyl | octenyl | 1,2-butylene | 1 | K |

DESCRIPTION OF THE PREFERRED EMBODIMENTS

The salt-forming cation M may be any of numerous materials such as alkali metal, alkaline earth metal, ammonium, or various organic cations. Examples of suitable organic cations include nitrogen-containing organic cations such as diethanolammonium and triethanolammonium cations. The alkali metal cations are preferred, and sodium ions are particularly preferred.

The alkyl and alkenyl groups which are attached to the succinic moiety may be branched or linear, although the substantially linear materials are preferred. By substantially linear is meant that the presence of a random methyl group, for example, somewhere on the chain will not be detrimental to their ability to be degraded. The preferred alkyl groups thus include the linear alkyl from tetradecyl to docosyl and the alkenyl groups will likewise be the linear materials from tetradecenyl to docosenyl.

The succinic anhydride precursors are preferably derived by the alkylation of maleic anhydride with a monoolefin to form alkenyl succinic anhydride followed in the case of the alkyl substituted materials by hydrogenation. The olefins may be derived from any source, examples being those derived from the cracking of waxes (alpha olefins) or those derived by dehydrogenation or halogenationdehydrohalogenation of appropriate paraffin fractions. From a commercial standpoint olefins derived by various dehydrogenation processes are preferred.

The reaction of olefin with maleic anhydride is performed as conventionally described in the art by contacting the anhydride with at least an equimolar amount, preferably an excess of olefin, usually at elevated temperatures, to form the desired anhydride.

The alkenyl materials may be converted to alkyl succinic anhydrides by conventional hydrogenation techniques. Alternatively and preferably, the hydrogenation is carried out with the half ester. Hydrogenation may thus be carried out in the presence of conventional catalysts such as platinum, platinum on inert supports, palladium, etc.

The alkenyl or alkyl succinic anhydride is reacted with an appropriate quantity of a lower glycol or lower polyglycol to yield the half ester. An approximately stoichiometric amount of the glycol or polyglycol will cleave the anhydride ring to form the desired compound having a free carboxyl group and a hydroxyl group on the glycol or polyglycol portion of the molecule. The use of an excess of the glycol is preferred.

Sulfation of the glycol substituted half ester to produce the acid precursor of the compound is accomplished by an appropriate sulfation method, such as with oleum, sulfuric acid, or chlorosulfonic acid.

The mixed carboxylic, sulfuric acid produced is reacted with an appropriate base in order to give the detergent-active salt which then may be compounded to form the desired detergent composition.

The preferred detergents contain one or two ethylene glycol units. Fish show markedly high tolerance to these materials. In addition, the preferred compounds contain a succinic moiety which is centrally attached on the hydrocarbyl chain.

The preparation of specific examples of these materials is described in U.S. patent application Ser. No. 259,924, the teachings of which are incorporated by reference.

The foam producing alcohols are represented by decyl, undecyl, dodecyl (lauryl), tridecyl and tetradecyl alcohols. Lauryl is preferred.

In addition to the detergent active half ester salts and foam boosting alcohols, detergent formulations will generally contain substantial quantities of other substances, particularly when dry or "powdered" formulations are used. Thus, while in general builders are not necessary for adequate detergency, in particular cases minor amounts of tripolyphosphate builders and other conventional builders may be included in the compositions.

Also, in dry formulations materials such as alkali metal salts, usually sodium sulfate, will be present as a byproduct of the sulfonation and neutralization reactions used to produce the detergent active and are not removed since they have no detrimental effect upon the detergent but, to the contrary, give a free flowing character to the detergent.

Other materials that may be optionally included in the formulations include but are not limited to anticorrosion and antiredeposition agents, foam boosters, etc.

The following tests illustrate the efficacy of compositions of this invention :

Foam tests were conducted in a Westinghouse side door washing machine. Detergent formulations were placed in the washer at 0.1% weight concentration. Washing was performed with 50 ppm hardness water at 125°F with a 3-terry towel load.

The following detergent active materials and builders were employed:

1. Sodium linear alkylbenzene sulfonate having 10–13 carbon alkyl chain (LAS).

2. Disodium sulfated diethylene glycol half ester of $C_{16-18}$ mono alkenyl succinic acid having the following structure:

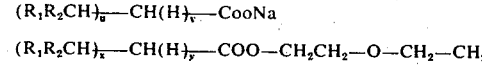

in which $u$, $v$, $x$ and $y$ are integers 0–1, the sum of $u$ and $x$ is 1, the sum of $u$ and $v$ is 1, and the sum of $x$ and $y$ is 1.

Formulations were prepared by adding the indicated weight percentages of detergent active and builder and foaming additive, 7% sodium silicate, 8% water, 1% carboxymethyl cellulose and sufficient sodium sulfate to make 100%.

The following table shows foam test results obtained including results obtained with a commercial low foaming detergent, ALL. The foam level is measured at the specified time intervals.

SIDE DOOR WASHER FOAM TEST
0.10% Concentration, 125°F.

| Ex. No. | Detergent Active Type | Detergent Active Concentration Wt. % in Formulation | Builder, STP,* Wt.% in Formulation | Lauryl Alcohol Wt. % in Formulation | Time, Min. | Foam, In. |
|---|---|---|---|---|---|---|
| 1 | Commercial ALL | — | — | — | 1 | <1 |
| | | | | | 5 | <1 |
| | | | | | 10 | 1 |
| 2 | 1 | 20% | 35% | | 1 | 5 |
| | | | | | 1.5 | Full |
| 3 | 2 | 25% | — | | 1 | <1 |
| | | | | | 5 | 1 |
| | | | | | 10 | 1 |
| 4 | 2 | 25% | — | 5% | 1 | <1 |
| | | | | | 5 | 3 |
| | | | | | 9 | Full |

*Sodium tripolyphosphate (STP).

These results show that the subject half ester salts, which when formulated without foam booster function as low foaming detergent actives, function as high foaming materials with the addition of an appropriate quantity of primary linear alcohol.

While the character of this invention has been described in detail with numerous examples,this has been done by way of illustration only and without limitation of the invention. It will be apparent to those skilled in the art that modifications and variations of the illustrative examples may be made in the practice of the invention within the scope of the following claims.

I claim:

1. Detergent composition comprising a. as a detergent-active component 1 part by weight of a compound of the formula

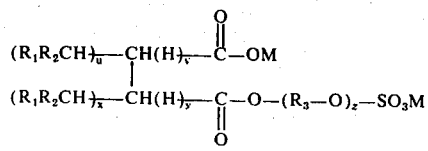

in which $R_1$ and $R_2$ are substantially linear saturated or unsaturated aliphatic groups of 3 to 19 carbon atoms, $R_3$ is alkylene of 2 to 4 carbon atoms, $u$, $v$, $x$, and $y$ are 0 or 1, $z$ is an integer 1 to 4, M is H or a water-soluble salt-forming cation, the sum of the carbon atoms in $R_1$ and $R_2$ is 13 to 21, the sum of the unsaturated sites in $R_1$ and $R_2$ is 0 to 1, the sum of $u$, and $v$ is 1, The sum of $x$ and $y$ is 1, and the sum of $u$ and $x$ is 1, and B. as a foam enhancing component, from 0.05 to 0.03 parts by weight of an essentially straight chain primary alcohol of 11 to 14 carbon atoms.

2. The composition of claim 1 in which the sum of the carbon atoms in $R_1$ and $R_2$ is from 15 to 17.

3. The composition of claim 2 in which $R_3$ is ethylene.

4. The composition of claim 3 in which $z$ is 2.

5. The composition of claim 1 in which the alcohol contains from 11 to 13 carbon atoms.

6. The composition of claim 1 in which the alcohol is lauryl alcohol.

* * * * *

UNITED STATES PATENT AND TRADEMARK OFFICE

CERTIFICATE OF CORRECTION

PATENT NO. : 3,935,131

DATED : January 27, 1976

INVENTOR(S) : Samuel H. Sharman

It is certified that error appears in the above-identified patent and that said Letters Patent are hereby corrected as shown below:

Col. 5, line 10, "0.03" should read --0.30--.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*